United States Patent [19]

Reedhead et al.

[11] 4,203,597

[45] May 20, 1980

[54] THROATLESS TENNIS RACQUET

[76] Inventors: Frederick W. Reedhead; Rowland E. Reedhead, both of Trenton; George W. Reynolds, Tinton Falls, all of N.J.

[21] Appl. No.: 939,761

[22] Filed: Sep. 5, 1978 (Under 37 CFR 1.47)

[51] Int. Cl.[2] ..... A63B 49/05; A63B 49/02

[52] U.S. Cl. ..... 273/73 E

[58] Field of Search ..... 273/73 R, 73 D, 73 E, 273/73 J

[56] References Cited

U.S. PATENT DOCUMENTS

| | | | |
|---|---|---|---|
| 240,183 | 4/1881 | Richardson | 273/73 E |
| 4,057,249 | 11/1977 | Reedhead et al. | 273/73 E |

FOREIGN PATENT DOCUMENTS

| | | | |
|---|---|---|---|
| 395032 | 7/1933 | United Kingdom | 273/73 E |

*Primary Examiner*—Charles E. Phillips
*Attorney, Agent, or Firm*—John J. Kane; Frederick A. Zoda; Albert Sperry

[57] ABSTRACT

An adjustable throatless tennis racquet including a head portion formed of two similar members disposed in spaced relation with respect to one another and separated by a plurality of spacers fixedly maintained therebetween by a plurality of pin members, the racquet further including a plurality of sheaves rotatably mounted preferably around the spacers and including a peripheral groove about the exterior thereof to receive therein a string as in conventional tennis racquets however such that the stringing is performed in a diagonal fashion, the ends of the stringing secured to a connector member in the top of the handle portion of the frame such that by lateral movement of the connector portion the strings throughout the surface of the diagonally strung racquet will be allowed to move axially with respect to the string itself, the connector being laterally movable within a space defined by the parallel extending surfaces of the two similar members, the racquet further including a mechanism for adjusting of the tension of the stringing by varying the tension exerted on the connector member in a direction axially with respect to the handle.

8 Claims, 5 Drawing Figures

THROATLESS TENNIS RACQUET

BACKGROUND OF THE INVENTION

1. Field of the Invention

Conventional tennis racquets generally include a wood or steel frame with stringing mounted therein in a horizontal and vertical fashion. Normally the string is inserted at a desired maximum tension. However this tension slowly decreases over a period of usage of the racquet. Therefore a means of continually varying the adjustment of the tension of the strings at a given moment is desirable.

Also the strings of a normal tennis racquet are bent about very narrow bending angles and as such are completely prevented from any axial movement thereof. The present invention provides a system for using a non-endless string which allows axial movement of the string itself when the racquet surface contacts a ball. In other words when a ball is struck by the racquet surface certain strings will move axially in certain chosen directions and provide additional action during contact with the tennis ball to improve control and accuracy.

Also in conventionally strung tennis racquets the minimization of axial movement of the stringing leads to frequent breakage of the strings themselves whereas if a means to allow axial movement of the strings would be provided then this breaking of the strings due to an excess amount of pressure being exerted on a given string section would be minimized. The present invention provides a means for creating an adjustable tennis racquet with a non-endless string wherein an amount of such axial movement is existing.

2. Description of the Prior Art

Examples of patents of the prior art pertinent to the present invention are as follows:

U.S. Pat. Nos. 240,183; 1,131,418; 1,476,906; 1,667,450; 1,682,199; 1,750,727; 1,862,581; 1,937,787; 2,034,444; 2,089,118; 2,109,525; 2,145,785; 2,206,548; 2,274,788; 2,969,984; 3,078,098; 3,083,968; 3,431,626; 3,528,658; 3,568,290; 3,711,092; 3,724,850; 3,801,099; 3,834,699; 3,901,507; 3,930,648; 3,934,876; 3,948,519; 4,023,799; 4,026,553; and 4,057,249.

Foreign Patents

Australia Pat. No. 208,945 Australia Pat. No. 252,990 France Pat. No. 784,057 France Pat. No. 812,970 Great Britain Pat. No. 4305 Great Britain Pat. No. 380,915 Great Britain Pat. No. 5358 and Germany Pat. No. 811,932.

Of particular note is U.S. Pat. No. 4,057,249 recently issued to the same above-named inventors which discloses a similar system using a stringing which is axially movable by means of a plurality of sheaves mounted in the head area of the tennis racquet. That concept differs substantially from the present invention due to the usage in that patent of a single endless string. The present invention provides a means for achieving the desired full axial movement as has been achieved in the U.S. Pat. No. 4,057,249 however without using an endless string but using a connector member which is allowed lateral movement. It has been found that the use of the single non-endless string is more easy to manufacture as well as facilitating the initial tensioning and placement of the stringing. Also by the elimination of the rotatable tensioning roller 38 a possible source of breakage is eliminated.

SUMMARY OF THE INVENTION

The present inventiion provides a throatless tennis racquet which has an easily adjustable spring tension characteristic. The racquet includes a frame having a handle portion and a head portion formed of two similar members each having a parallel extending flat surface in spaced relationship with respect to one another. Each similar member is preferably of a hollow material having a rear surface which is generally parabolic and an opposite surface which is the parallel extending surface.

These parallel extending surfaces are maintained in spaced relationship with respect to one another by a plurality of spacers which are positioned between the parallel surfaces. A retaining means is included for holding these similar members fixedly in the spaced relationship. In the head portion of the racquet the retaining means takes the form of a wrap means extending transversely about both of said similar members at a plurality of locations. In the handle portion of the frame the retaining means takes the form of a plurality of pin means which are fixedly secured to each of the similar members at approximately evenly spaced locations.

Between the parallel extending surfaces of the similar members in the head area a plurality of rotatably mounted sheaves are located. These sheaves define a peripheral groove therearound adapted to receive stringing for providing the strung hitting surface of the racquet. The frame further includes a grip means which extends about the two similar members in the generally lower area of the handle portion.

The racquet includes a stringing means which is maintained in a diagonal orientation and which passes around the peripheral grooves of each sheave in the head area. In this manner the diagonally strung hitting surface is formed and the ends of the stringing are fixedly secured at a terminal location to a connector member.

The tensioning means includes the connector member which itself is axially movable with respect to the handle toward or away from the hitting surface. In this manner the amount of tension exerted on the connector member and on the stringing itself is varied by adjusting of the tensioning means. An adjusting means is rotatably mounted to the bottom end of the handle portion of the frame and is connected by a flexible steel wire means to the connector member to vary the amount of tension exerted axially thereon.

The adjuster means may include a threaded male member extending axially through the handle portion of the frame as well as a lateral member which defines a centrally located threaded aperture therein. This threaded aperture is mated with the threaded male member to receive same such that the rotation of the adjuster means which causes rotation of the threaded male member will cause movement of the lateral member toward or away from the bottom of the handle by the threading of the threaded aperture about the threaded male member. In this manner a variable amount of pressure will be exerted downwardly on the steel wire and as such the amount of tension directed on the connector member away from the stringing area can be modified as desired.

The sheaves in the head area of the racquet of the present invention may be mounted rotatably about the spacers which maintain the spaced relationship between the parallel extending surfaces of the two similar members. Also the pin means may be fixedly secured to the two similar members and may extend axially through these same spacers.

To facilitate holding of the gripping means the similar members each defines a longitudinal void space therebetween on the exterior surface thereof in the handle area. In this mannwer when the gripping means is tightly wound about the handle area a longitudinal depression will be formed therein to facilitate the placement of the fingertips or other portion of the hand into those depressed areas. To provide a softer handle area a filler material may be located wrapped around the two similar members in between the outer surface of the two similar members and the inner surface of the gripping means material.

It is an object of the present invention to provide a throatless tennis racquet wherein the tension at which the strings are strung is conveniently and readily adjustable.

It is an object of the present invention to provide a throatless tennis racquet having a frame member which is formed of two similar members each including parallel extending surfaces maintained in spaced relationship with respect to one another by a plurality of spacers.

It is an object of the present invention to provide an adjustable throatless tennis racquet which is very easy to string and convenient in which to vary the amount of tension of the string.

It is an object of the present invention to provide an adjustable throatless tennis racquet including a plurality of sheaves about which the stringing is located to allow axial movement of the stringing during contact with the tennis ball.

It is an object of the present invention to provide an adjustable throatless tennis racquet wherein the stringing is axially movable and also strung in a diagonal direction.

It is an object of the present invention to provide an adjustable throatless tennis racquet including a plurality of retaining means for holding two similar members in spaced relationship with respect to one another.

It is an object of the present invention to provide an adjustable throatless tennis racquet which makes use of a non-endless string wherein the ends thereof are fixedly secured to a connector member which is laterally movable to allow axial movement of the strings.

It is an object of the present invention to provide an adjustable throatless tennis racquet which includes a rotatable adjuster means mounted to the bottom of the handle which is connected by a flexible steel wire means to said stringing to vary the amount of tension exerted on said stringing.

It is an object of the present invention to provide an adjustable throatless tennis racquet including a longitudinal depression in the handle area to facilitate gripping thereof.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
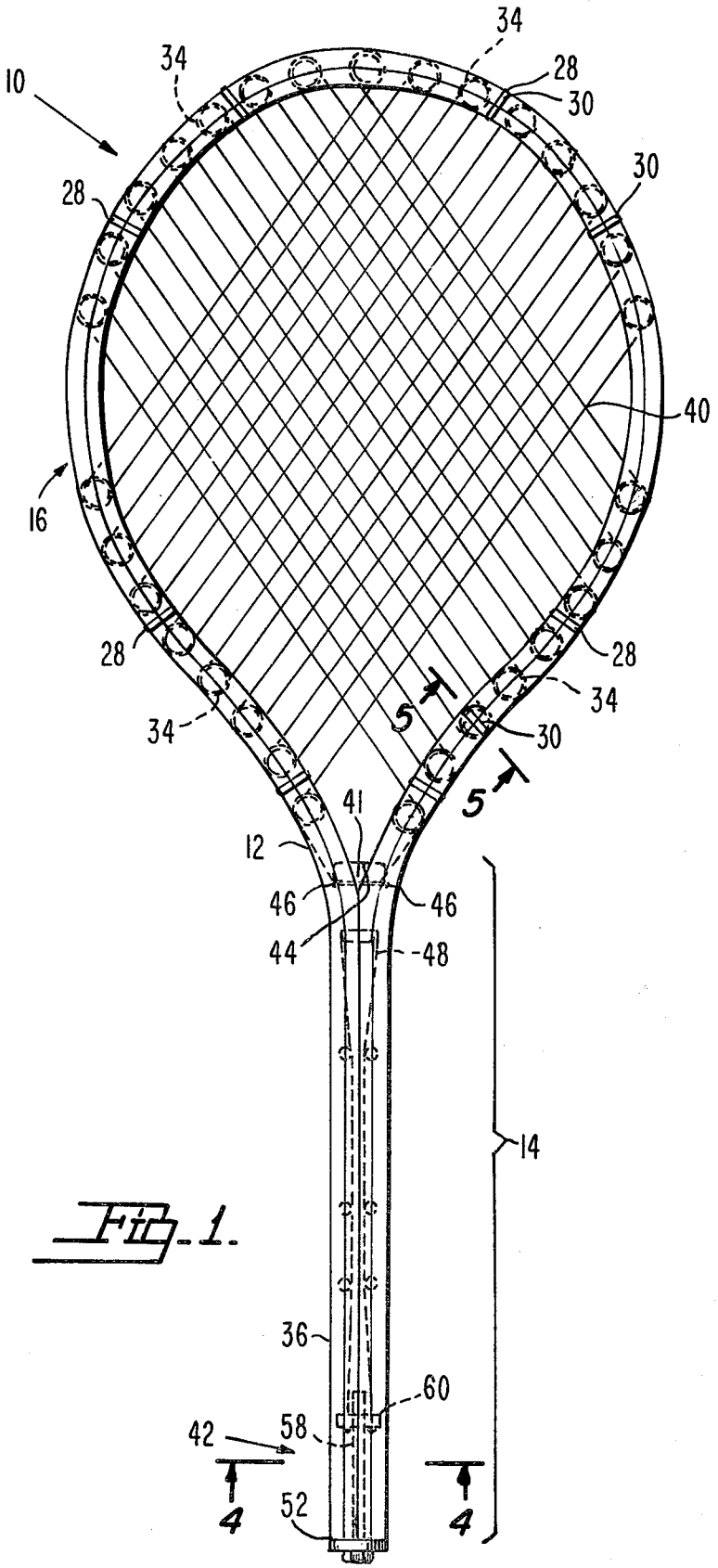
FIG. 1 is a front view of an embodiment of the adjustable throatless tennis racquet of the present invention.
Figure 3:
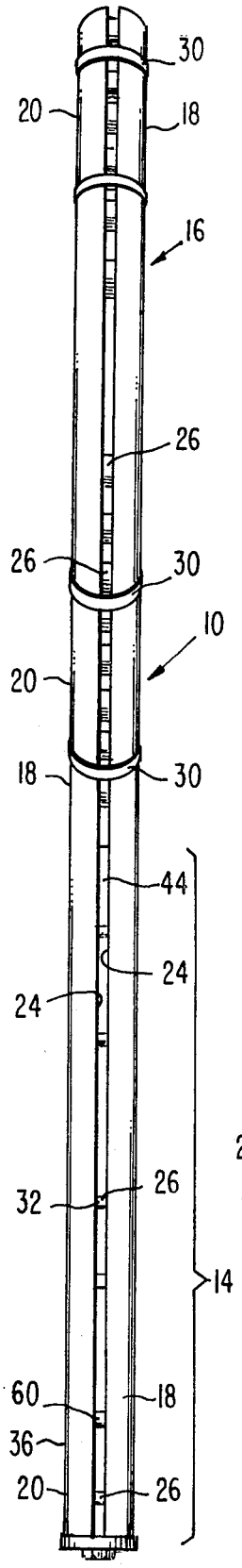
FIG. 3 is a side view of the embodiment shown in FIG. 1.
Figure 5:
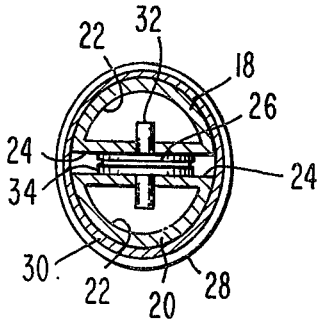
FIG. 5 is a cross-sectional view of the embodiment shown in FIG. 1 along lines 5—5.
Figure 4:
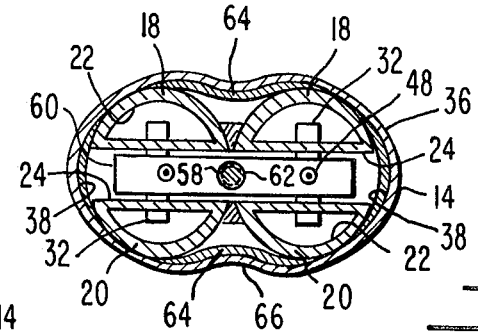
FIG. 4 is a cross-sectional view of the embodiment shown in FIG. 1 along lines 4—4.

In an embodiment of the tennis racquet 10 of the present invention is included a frame 12 defining a handle portion 14 which extends downwardly from the dotted line in FIG. 1 and a head portion 16 which extends upwardly from the dotted line shown in FIG. 1. The basic construction of the frame 12 includes two similar members 18 and 20 which are each generally shaped in a round manner for the head portion and which come together and travel parallel for a section in the handle portion 14. Members 18 and 20 are generally formed of a hollow material having surfaces 24 extending parallel with respect to one another throughout the entire handle portion 14 and head portion 16. This configuration is best shown in side view in FIG. 3 and in end view in FIGS. 4 and 5. The surfaces 24 are shown extending parallel with respect to one another and the hollow material 22 is best shown in FIGS. 1 and 5. The members 18 and 20 include arcuate surfaces opposite from the parallel extending surfaces 24.

The members 18 and 20 are maintained in spaced relation with respect to one another by way of spacers 26 which are located throughout the entire frame 12 of the racquet 10. In order to hold the spacers in place between the parallel extending surfaces 24 a retaining means 28 is included. Retaining means 28 takes the form of a wrap means in the head portion 16 of the frame 12. Wrap means 30 may take the form of a winding or tape which extends about the outer surfaces of the similar members 18 and 20 to thereby hold the parallel extending surfaces 24 in abutment with the spacers 26. The retaining means 28 may take the form of a pin means 32 specifically in the handle portion 14 wherein preferably the pin means 32 extends through the center of the spacers 26. In the handle portion of the frame the spacers 26 preferably take the form of collars which fit about the pin means 32 which extend into the similar members 18 and 20 by protruding through the parallel extending surfaces 24. In this manner the surfaces 24 are maintained in abutment with the spacers 26 throughout the handle portion 14 and the head portion 16 of the frame 12.

The head portion 16 of an embodiment of the present invention includes a diagonal stringing means 40 which extends about a plurality of sheaves 34 which are mounted between the parallel extending surfaces 24 of the similar members 18 and 20 in the head portion 16 of the racquet. The sheaves preferably include a peripheral groove about the exterior thereof adapted to receive the diagonal stringing means. The ends of the stringing means 46 are connected to a tensioning means 42 for controlling the amount of tension on the diagonal stringing.

Figure 2:
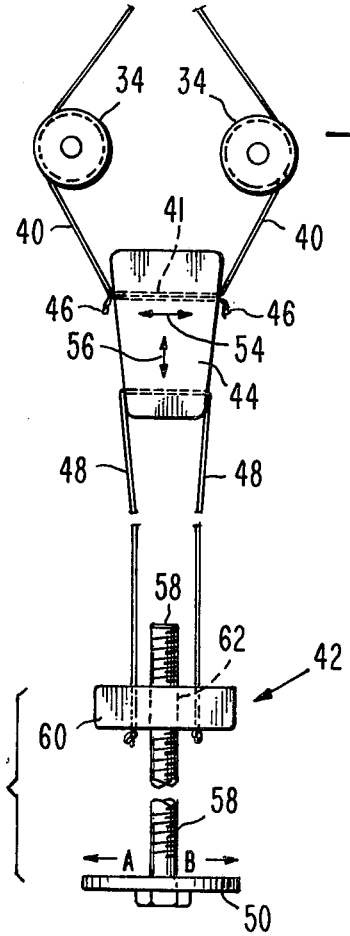
FIG. 2 is a front view of an embodiment of the adjusting mechanism of the present invention.

The tensioning means includes an adjuster means 50 positioned adjacent the bottom of the handle portion 52. The adjuster means 50 is rotatably mounted to bottom 52 such that rotation thereof may increase or decrease the amount of tension being exerted by the tensioning means 42 on the stringing 40. Tensioning means 42 includes a connector member 44 which is located in the handle portion 14 immediately adjacent to the diagonal stringing 40. Connector 44 is adapted to receive the ends 46 of the stringing means in fixed engagement therewith. As shown in the present embodiment the stringing 40 may be adapted to pass through an aperture 41 defined in the connector member 44. FIG. 2 shows the stringing 40 extending through the aperture 41 and the ends thereof tied into a knot at each opposite end of the aperture. In this manner a fixed attachment is achieved between the connector member and the stringing and the usage of a non-endless string is allowable. Therefore the tensioning means 42 basically comprises a means for selectively moving the connector member 44 toward and away from the strung surface of stringing means 40. This movement is defined as direction 56 of longitudinal movement of the connector. Arrow 56 shows this direction of movement. One of the inventive characteristics of the present invention includes the adaptability of the connector member for such longitudinal movement 56 in combination with the capability for moving in the direction of the lateral movement by the connector shown by arrow 54. This lateral movement is a result of axial movement of the stringing during contact with a ball which is made possible by the usage of sheaves 34 about which the stringing 40 is mounted. Therefore we have an adjustable tennis racquet system which allows full axial freedom of movement of the stringing while at the same time utilizing a non-endless string.

In order to control the movement of the connector member 44 in the direction shown by arrow 56 a flexible steel wire means 48 which is preferably of steel will be adapted to pass through an aperture in the bottom section of the connector member 44. This steel wire means will be connected to the peripheral edges of a lateral member 60. Preferably lateral member 60 will include a threaded aperture 62 adapted to receive a threaded male member which is fixedly secured to the adjuster means 50. Preferably the adjuster means 50 will include a rotatable disc mounted adjacent the bottom of the handle portion 52. The disc should be preferably fixedly secured to the threaded male member 58. in this manner rotation of the disc in the direction shown by arrow B will cause a rotation of the member 58 within aperture 62 and, as shown in FIG. 2, a downward movement of the lateral member 60 resulting in a downward movement of the wire means 48 causing a further downward movement by the connector member 44 causing tightening of the stringing 40. Alternatively, a counterclockwise rotation of the disc in the direction shown by arrow A will cause the opposite movement described above with a consequential loosening of the tension exerted on the stringing 40. In this manner a tensioning adjustment means can be utilized with an axially movable stringing surface for a tennis racquet wherein the stringing surface is non-endless.

The racquet 10 of the present invention includes a grip means 36 located near the bottom portion of the handle portion 14. The grip means may take the form of a perforated leather wrap or other conventionally used gripping surface but may include under the grip means a second layer of perhaps softer material to comprise a filler material 38 to thereby control the softness of the gripping surface. As shown best in FIG. 4 a void space 64 will be created between the adjacent parallel surfaces of each similar member 18 and 20. This void space will allow a slight compression or longitudinal depression 66 extending along the grip means 36. The perforated leather allows full breathing of the air within the void space 64 and prevents perspiration wetting of the grip means 36. This slight depression will form a convenient location for placement of the fingertips of the use of the tennis racquet or any other portion of the user's hand which he desires to be placed in contact with this depressed surface. In this manner a non-regular gripping means will be provided to facilitate holding of the racquet.

The novel configuration of the stringing of the present invention in combination with the novel racquet head configuration provide increased flexing of the racquet during contact with a ball. This additional effect is created because the present configuration allows the elimination of the throat member normally used in conventional tennis racquets. This throat reduces flexing of the racquet during contact with the ball in both directions. That is, lateral flexing is minimized by the throat piece of conventional tennis racquets since the lateral direction of the hitting surface is restricted thereby. Similarly and even more importantly longitudinal flexing between the top of the hitting surface of the racquet and the bottom portion of the handle is inhibited by the usage of such throat pieces and the present invention overcomes this difficulty and the above described difficulty to provide a tennis racquet having increased lateral and longitudinal flexing characteristics.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. An adjustable throatless tennis racquet comprising:

(a) a frame including a handle portion and a head portion, said frame comprising:

(1) two similar members each formed of hollow material and including surfaces extending parallel and disposed in spaced relationship with respect to one another;

(2) a plurality of spacers positioned between said parallel surfaces to maintain the spaced relationship therebetween;

(3) retaining means for holding said members fixedly in spaced relation with respect to one another, said retaining means including a wrap means extending transversely about both of the said similar members at a plurality of locations along said head portion of said frame, said retaining means also including a plurality of pin means fixedly secured to each of said similar members in said handle portion of said frame;

(4) a plurality of rotatably mounted sheaves positioned in said head portion of said frame between said parallel surfaces of said members; and (5) a grip means extending about said two similar members in said handle portion;

(b) diagonal stringing means positioned extending around each of said rotatable sheaves to form a diagonally strung hitting surface within said head portion wherein the strings are free to move axially during contact with a ball, said stringing also being fixedly secured to a movable means for tension adjustment;

(c) tensioning means for adjusting the tension of the diagonal stringing including:

(1) a connector member being located between said parallel surfaces of said similar members in said handle portion adjacent said diagonal stringing means, said connector member being fixedly secured to the ends of said diagonal stringing means to be movable therewith laterally or longitudinally with respect to said handle portion;

(2) a flexible wire means fixedly secured to said connector to allow lateral movement thereof; and (3) an adjuster means rotatably mounted to the bottom end of said handle portion, said adjuster means being connected to said flexible wire means to adjust the amount of tension thereon to cause axial movement of said connector member to vary the tension on said diagonal stringing means.

2. The racquet as defined in claim 1 wherein said adjuster means includes:

(a) a threaded male member extending axially in said handle portion; and (b) a lateral member defining therein a centrally located threaded aperture to receive said threaded male member, said lateral member being fixedly secured to said flexible wire means to vary the tension thereof responsive to rotation of said male member within said aperture caused by rotation of said adjuster means.

3. The racquet as defined in claim 1 wherein said flexible wire means comprises steel wire.

4. The racquet as defined in claim 1 wherein said sheaves are rotatably mounted about said spacers located in said head portion of said frame.

5. The racquet as defined in claim 1 wherein said pin means is fixedly secured to said similar members and extends axially through said spacers.

6. The racquet as defined in claim 1 wherein each of said similar members defines a longitudinal void space in said handle portion which provides a longitudinal depression in said grip means to facilitate holding thereof.

7. The racquet as defined in claim 1 further including a filler material located between said grip means and each of said similar members to soften said gripping means.

8. An adjustable throatless tennis racquet comprising:

(a) a frame including a handle portion and a head portion, said frame comprising:

(1) two similar members each formed of hollow material and including surfaces extending parallel and disposed in spaced relation with respect to one another;

(2) a plurality of spacers positioned between said parallel surfaces to maintain the spaced relationship therebetween;

(3) retaining means for holding said members fixedly in spaced relation with respect to one another, said retaining means including a wrap means extending transversely about both of said similar members at a plurality of locations along said head portion of said frame, said retaining means also including a plurality of pin means fixedly secured to each of said similar members in said handle portion of said frame;

(4) a plurality of rotatably mounted sheaves positioned around said spacers in said head portion of said frame between said parallel surfaces of said member;

(5) grip means extending about said two similar members in said handle portion, said similar members defining a longitudinal void space in said handle portion to provide a longitudinal depression in said grip means to facilitate gripping thereof;

(b) diagonal stringing means positioned extending around each of said rotatable sheaves to form a diagonally strung hitting surface within said head portion wherein the strings are free to move axially during contact with a ball, said stringing also being fixedly secured to a movable means for tension adjustment;

(c) tensioning means for adjusting the tension of the diagonal stringing including:

(1) a connector member being located between said parallel surfaces of said similar members in said handle portion adjacent said diagonal stringing means, said connector member being fixedly secured to the ends of said diagonal stringing means to be movable therewith laterally or longitudinally with respect to said handle portion;

(2) a flexible steel wire means fixedly secured to said connector to allow lateral movement thereof; and (3) an adjuster means rotatably mounted to the bottom end of said handle portion, said adjuster means being connected to said flexible wire means to adjust the amount of tension thereon to cause axial movement of said connector member to vary the tension on said diagonal stringing means, said adjuster means including:

(a) a threaded male member extending axially in said handle portion; and (b) a lateral member defining therein a centrally located threaded aperture to receive said threaded male member, said lateral member being fixedly secured to said flexible wire means to vary the tension thereon responsive to rotation of said male member within said aperture caused by rotation of said adjuster means.

* * * * *